United States Patent [19]

Logan

[11] 4,398,129

[45] Aug. 9, 1983

[54] ACTIVE LAMP PULSE DRIVER CIRCUIT

[75] Inventor: Kenyon E. Logan, Longwood, Fla.

[73] Assignee: The United States of America as represented by the Administrator of the National Aeronautics and Space Administration, Washington, D.C.

[21] Appl. No.: 276,748

[22] Filed: Jun. 24, 1981

[51] Int. Cl.[3] ..... H05B 41/14

[52] U.S. Cl. ..... 315/208; 315/224; 315/225; 315/237; 315/241 R; 372/25

[58] Field of Search ..... 315/208, 224, 225, 237, 315/241 P, 241 R, 311; 372/10, 25, 26, 70

[56] References Cited

U.S. PATENT DOCUMENTS

| | | | |
|---|---|---|---|
| 3,430,159 | 2/1969 | Roeber | 372/38 |
| 3,551,738 | 12/1970 | Young | 315/171 |
| 3,646,395 | 2/1972 | De Pratti | 315/242 |
| 3,668,548 | 6/1972 | Osial et al. | 372/38 |
| 3,806,762 | 4/1974 | Punis et al. | 315/307 |
| 3,938,060 | 2/1976 | Kato et al. | 372/26 |
| 4,005,333 | 1/1977 | Nichols | 315/173 |
| 4,074,208 | 2/1978 | Mack et al. | 372/72 |
| 4,168,453 | 9/1979 | Gerhard et al. | 315/225 |
| 4,275,335 | 6/1981 | Ishida | 315/208 X |

*Primary Examiner*—Eugene R. LaRoche
*Assistant Examiner*—Vincent DeLuca
*Attorney, Agent, or Firm*—John O. Tresansky; John R. Manning; Robert E. Bushnell

[57] ABSTRACT

A flashlamp drive circuit 10 using an unsaturated transistor Q1 as a current mode switch to periodically subject a partially ionized gaseous laser excitation flashlamp 20 to a stable, rectangular pulse of current from an incomplete discharge of an energy storage capacitor C1. A monostable multivibrator MV1 sets the pulse interval, initiating the pulse in response to a flash command by providing a reference voltage to a non-inverting terminal of a base drive amplifier AV1; a tap on an emitter resistor R2 provides a feedback signal sensitive to the current amplitude to an inverting terminal of amplifier AV1, thereby controlling the pulse amplitude. The circuit drives flashlamp 20 to provide a square-wave current flashlamp discharge.

17 Claims, 13 Drawing Figures

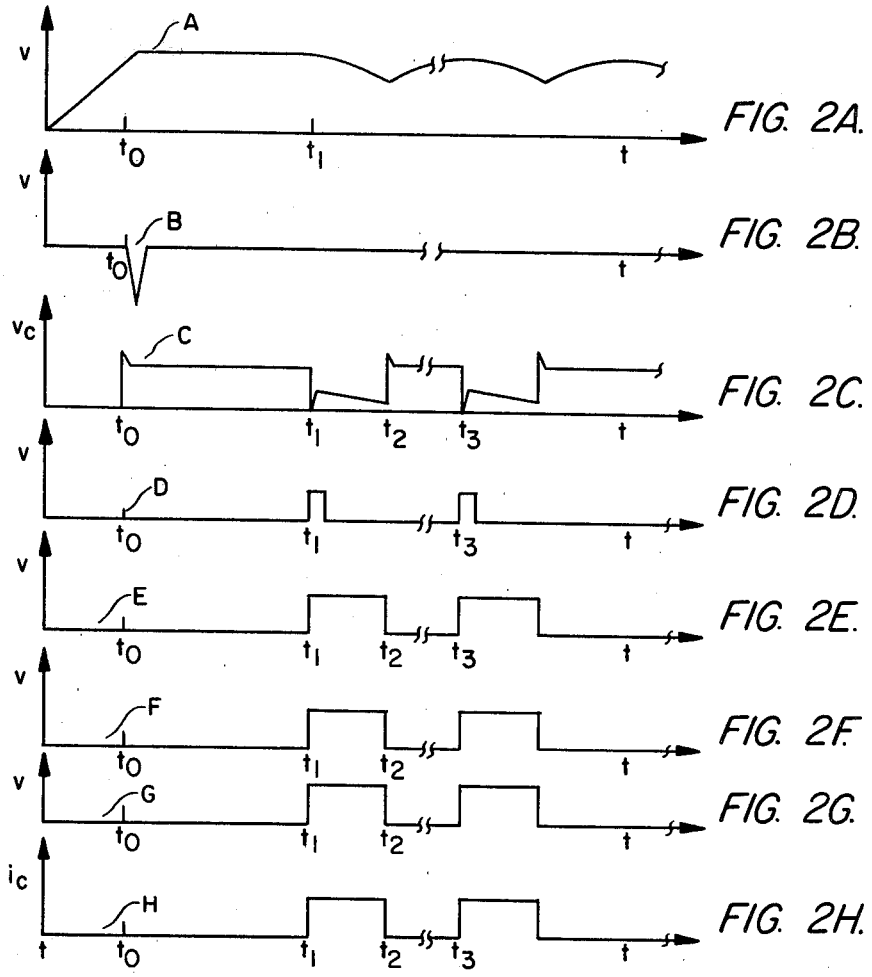
v
A
$t_0$
$t_1$
t
FIG. 2A.
v
B
$t_0$
t
FIG. 2B.
$v_c$
C
$t_0$
$t_1$
$t_2$
$t_3$
t
FIG. 2C.
v
D
$t_0$
$t_1$
$t_3$
t
FIG. 2D.
v
E
$t_0$
$t_1$
$t_2$
$t_3$
t
FIG. 2E.
v
F
$t_0$
$t_1$
$t_2$
t
FIG. 2F.
v
G
$t_0$
$t_1$
$t_2$
t
FIG. 2G.
$i_c$
H
t
$t_0$
$t_1$
$t_2$
$t_3$
t
FIG. 2H.
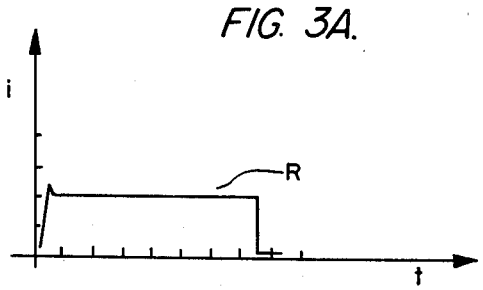
FIG. 3A.
i
R
t

ACTIVE LAMP PULSE DRIVER CIRCUIT

ORIGIN OF THE INVENTION

The invention described herein was made in the performance of work under a NASA contract and is subject to the provisions of section 305 of the National Aeronautics and Space Act of 1958, Public Law 85-568 (72 Stat. 435; 42 U.S.C. 2457).

TECHNICAL FIELD

The invention relates to molecular and particle type oscillators and, more particularly, to optical pumping of laser media in those oscillators.

BACKGROUND ART

Application of laser technology to such diverse fields as geophysical measurement (e.g., land surveying, range finding) and long distance communication (e.g., electrooptic communication networks) has created a need to improve the performance of laser transmitters to equal the demands in those arts for precision. Precision is a function of the accuracy and resolution provided by an instrument used to make a measurement. In an optically pumped, continuous-wave pulse laser transmitter, precision requires generation of very short laser emission pulses readily susceptible to accurate resolution by a receiver. Accurate resolution is enhanced by a laser transmitter providing light pulses with narrow pulse width and stable temporal waveforms.

Basically, the laser medium of a laser transmitter is an active device which exhibits a gain phenomenon. The medium serves as the active component of an oscillator called a resonator. In an optically pumped laser, a flash lamp, electrically driven into ionization, transfers energy in the form of intense bursts of light to the laser medium. The quantity of energy transferred must exceed the base threshold of the medium to excite the medium to emission. The waveform of the laser emission pulse closely resembles the waveform of the burst of light from the flashlamp. A medium pumped by a single spike of light energy, for example, will emit a pulse exhibiting a gaussian waveform.

Any small noise source, whether internal or external to the laser medium, manifests itself as instability in the laser resonator, and has the ability to upset the steady state dynamic condition of the laser transmitter. Instability in the resonator causes emission of multiple, nonuniform laser pulses. One consequence of this is that when repetitively pumped by a flash lamp driven by a pulse forming network, particularly a multi-mesh network, successive pulses emitted by the lamp, and thus the laser resonator, tend to unpredictably differ in such waveform characteristics as amplitude and pulse width. There are two causes for this. First, the energy emitted by a flashlamp is very sensitive to changes of impedance. The lamp impedance changes drastically (by several orders of magnitude) with variations in the lamp current. Second, pulse forming networks, primarily one or more parallel stages each with an energy storage capacitor and an inductor coupled across the electrodes of a lamp, inherently exhibit a ripple in the amplitude of current provided to the lamp. The inherent ripple is compounded in multi-mesh type pulse forming networks. To avoid instability in the resonator, the amount of ripple in the amplitude of the discharge current pulse driving the flashlamp would be limited to less than one-half of one percent. Generally, multi-mesh pulse forming networks exhibit between two and five percent ripple in the discharge current pulse.

Pulse forming networks previously used to address the need for providing temporally uniform pulses to the laser medium and, therefore, the flashlamp pumping the medium, have sought to provide rectangular discharge pulses to the flashlamp by modifying the exponential decay of the discharge pulse. These networks include a silicon controlled rectifier which shorts the flashlamp when fired by a time delay stage set by the same initializing pulse that fires the lamp. Another prior art network relies upon a mismatch of impedance between the network and the lamp to cause a reversal of polarity shortly after the lamp is fired, thereby assuring a quick turnoff of a switching device located between the network and the lamp. Neither exemplar addresses the problem of maintaining the impedance of the flashlamp and thus, the amplitude of the power transferred to the laser resonator, constant during the discharge pulse.

STATEMENT OF THE INVENTION

It is, therefore, one object of the present invention to provide a laser transmitter for generating short light pulses displaying stable temporal waveforms.

It is a second object to provide a laser transmitter repetitively emitting light pulses susceptible to accurate resolution by a receiver.

It is another object to provide a laser transmitter repetitively emitting light pulses of uniform amplitude and pulsewidth.

It is yet another object to provide an active flashlamp drive circuit.

It is still another object to provide an active circuit for driving a flashlamp with a constant amplitude current pulse.

It is a further object to provide an active circuit for driving a flashlamp with a discharge current substantially free of ripples.

It is a still further object to provide a flashlamp drive circuit which can compensate for one or more ambient variations contributing to instability of a laser resonator.

Another still further object is to provide a flashlamp drive circuit for repetitively pulsing a flashlamp with temporarily uniform pulses of current.

It is a further object to provide an active flashlamp drive circuit facilitating generation of stable laser pulses of uniform profile.

These and other objects are achieved with a flashlamp pump driven by an active lamp driver circuit providing highly stable, rectangular pulses of discharge current. After the lamp has been placed in a partially ionized state by an ignition voltage pulse from an external source, a transistor in the circuit, held below saturation in an active, common emitter configuration, cyclically switches the amplitude of current through the lamp between two modes—a simmer condition maintaining partial ionization and a total ionization pumping condition. Voltage on the base of the transistor is controlled by an initializing stage of the circuit which sets the width of the cyclical pulses of discharge current; a feedback loop sensitive to emitter current regulates the amplitude of the pulses. When driven by this circuit (that is, by a periodic series of current pulses uniform in amplitude and width), the flashlamp is enabled to pump a laser medium with a series of uniform, rectangular irradiance pulses, thereby causing the medium to radiate a quasi-continuous wave of short pulses sufficiently stable in width and amplitude to provide accurate resolution upon reception.

BRIEF DESCRIPTION OF THE DRAWINGS

A more complete appreciation of this invention, and many of the attendant advantages thereof, will be more readily apparent as the same becomes better understood by reference to the following detailed description when considered in conjunction with the acccompanying drawings in which like reference symbols indicate the same or similar components, and wherein:

FIGS. 2A through 2H are two coordinate graphic representations of voltage and current waveforms as a function of time taken at various points within the circuit shown in FIG. 1.

FIG. 3A is a two coordinate graphic representation of a drive current pulse applied to a partially ionized flashlamp.

DETAILED DESCRIPTION OF THE INVENTION

Figure 1:
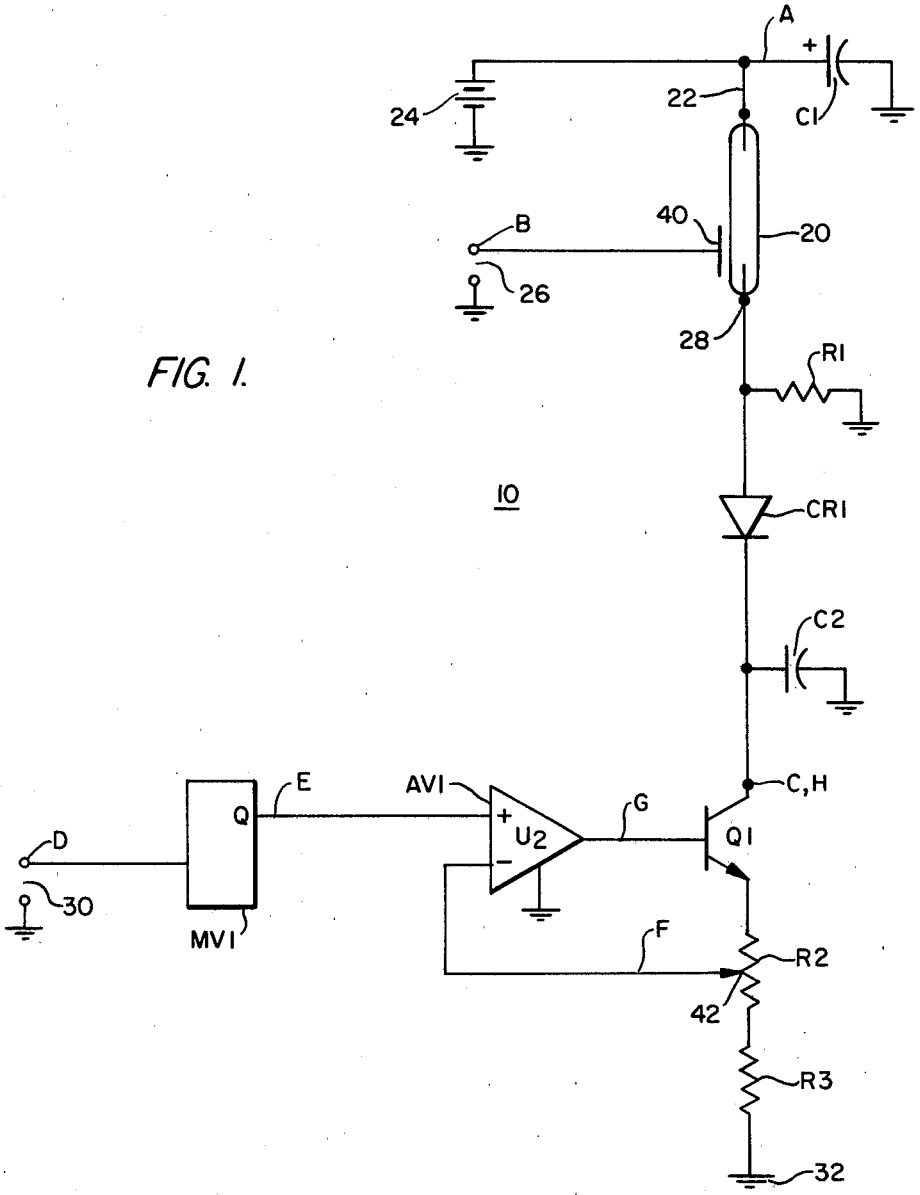
FIG. 1 is a simplified schematic diagram of the driver circuit of this invention.

Referring now particularly to FIG. 1, an active lamp driver circuit, generally designated by reference symbol 10, is shown for controlling electrical current through a load resistance such as a partially evacuated, gas filled flashlamp 20 during ignition of the lamp and during each of its two operational modes—a simmer condition and a total ionization state. Flashlamp 20 may be used to pump a laser medium in the resonator cavity of a laser transmitter (not shown). When used in this manner, lamp 20 is cyclically driven by circuit 10 between its two operational modes. A power supply 24 is typically made small for reasons of cost and is unable to provide adequate electrical current to the load for such functions as creating a total ionization condition. Consequently, a storage capacitor C1 is coupled between a reference potential, such as ground, and one electrode, the anode, 22 of lamp 20 to serve as an integrator and accumulator for the direct current power supply 24 connected in parallel therewith. Power supply 24 applies a positive potential to lamp 20 via anode 22 during the simmer condition. During the simmer condition, current flows from power supply 24, through the fill gas of lamp 20 between electrodes 22, 28, and through load resistor R1 to ground. Power supply 24 also charges capacitor C1 during the simmer condition to a voltage in excess of the potential required to create total ionization within lamp 20. The waveform shown in FIG. 2A illustrates the charge on capacitor C1 beginning with the application of power supply 24 at time $t_o$ and continuing through one complete cycle.

Ionization of gas within lamp 20 results in a current flow within the fill gas of lamp 20. An ignition electrode 40 surrounds flashlamp 20. Initial ionization of the gas is caused by parallel triggering, that is, by application of an ignition voltage pulse, represented by waveform B shown in FIG. 2B, across a terminal 26 to the lamp via ignition electrode 40 at time $t_o$ while power supply 24 is coupled to anode 22 of the lamp. The ignition pulse is negative in polarity, with a voltage amplitude sufficient to create an arc partially filling the bore of lamp 20. A transistor Q1 is connected in a common emitter configuration with its collector coupled in series with the cathode 28 of lamp 20 and its emitter coupled via resistances R2, R3, to a ground or common reference potential 32. Transistor Q1 operates as a current mode switch to actively switch the amplitude of the current through lamp 20 between the two operational modes. Waveform C, shown in FIG. 2C, represents the voltage on the collector of transistor Q1 as a function of time. A capacitor C2 is connected between the collector of transistor Q1 and ground and is charged by the pulse to act as a spike suppression device to attenuate the ignition voltage pulse thereby protecting transistor Q1 from a severe current spike shown resulting from application of the ignition voltage to lamp 20. Resistor R1, connected between electrode 28, a cathode longitudinally opposite anode 22, and ground, limits the voltage across capacitor C2 as the current rises.

After capacitor C1 is fully charged, ignition voltage pulse B is applied across terminals 26 at time $t_1$. The ignition voltage pulse is sufficient to cause partial ionization of the gas and briefly create an arc extending across lamp 20. Then, the positive potential on anode 22 maintains the small amplitude "simmer" current flow between anode 22 and cathode 28, thereby maintaining the partial ionization arc, the first of the two operational conditions, within the bore of lamp 20. Resistor R1 and the low current impedance of lamp 20 establish the amplitude of the simmer current for lamp 20. Current flow during the simmer condition is from source 24, through the ionized lamp fill gas, and through resistor R1 to ground.

The rapidity with which a circuit may react to change the simmer current and lamp voltage in response to arc path length variations occurring within the lamp is indicated by the term "compliance." Variation in arc path length is a direct result of the amplitude of the simmer current. The low amplitude of the simmer current results in an arc path only. Insufficient current exists during this condition to create a significant plasma within the envelope of lamp 20. Consequently, the arc path established is apt to follow the inner walls of lamp 20, and is subject to various thermal agitations of the fill gas (i.e., convection currents). Additionally, because the arc path is formed from an ionized gas and is therefore conductive, the presence of various magnetic fields both within and without an adjacent laser resonator cavity tend to displace the arc path in response to changes of magnetic amplitude or intensity. The lamp voltage, that is, the potential which exists between anode 22 and cathode 28, is linearly related to the arc path length. As the arc path length changes, the lamp voltage must also change. A short arc length results in a lower lamp voltage while a long arc length results in a higher lamp voltage. The magnitude of change in lamp voltage due to arc length variations is quite small (e.g., less than ten volts); any loading which severely limits the bandwidth of the simmer state segment of the lamp driver circuit 10 however, results in "blow-out" of the arc path, thereby causing the simmer condition to fail.

To prevent impedance components external to the simmer stage, especially capacitor C2, from impairing the compliance of the simmer circuit, a diode CR1 may be interposed between resistor R1 and capacitor C2 to decouple transistor Q1 and capacitor C2 from the path of the simmer current because no current flows in transistor Q1 during the simmer condition. The load imposed on the simmer stage by diode CR1 is small and has an insignificant effect upon the arc path length.

By maintaining the basic arc between electrodes 22, 28, the simmer current eliminates a "come-on" time preceding total ionization of lamp 20. Ignition voltage pulse B is applied to electrode 40 only once to initiate the simmer condition, and remains dormant until an occurrence of blow-out necessitates re-energization of lamp 20. Lamp 20 has a negative resistance characteristic until its bore is completely filled with a plasma of its resident gas. A drive current proportional in amplitude to the bore length of lamp 20 and several microseconds in length, is capable of causing this, a total ionization condition. The instantaneous power radiated by lamp 20 during total ionization is a function of the product of the current through the lamp and the voltage drop across the electrodes 22, 28 due to that current.

The second operational mode of flashlamp 20 begins when a drive current pulse created by partial discharge of capacitor C1 causes complete ionization of the gas within the bore of lamp 20, enabling the lamp to radiate energy and thereby pump a laser medium. A monostable multivibrator MV1 is included in circuit 10 as an initializing device to set the interval of the drive current pulse which, in turn, controls the length of time during which energy is radiated by lamp 20—the "flash-time" interval. Normally, the Q terminal of multivibrator MV1 is in a quiescent state with a ZERO logic level of zero volts potential. Application of a flash command, represented by waveform D in FIG. 2D, from an external timing circuit (not shown), to a terminal 30 causes a low-to-high transition which shifts the Q terminal of multivibrator MV1 from a ZERO to a ONE logic level, a pulse represented by waveform E in FIG. 2E. An amplification device, operational amplifier AV1, has a noninverting terminal connected to the Q terminal of multivibrator MV1; amplifier AV1 provides a drive signal to the base of transistor Q1. When multivibrator MV1 is in its quiescent state, operational amplifier AV1 holds the base of transistor Q1 at zero volts potential. Therefore, when multivibrator MV1 is quiescent, no current flows in transistor Q1. The ONE logic level is a reference voltage for the non-inverting terminal of amplifier AV1 which, in turn, holds a positive voltage (represented by waveform F in FIG. 2F) on transistor Q1.

A pair of resistors R2 and R3 are coupled in series between the emitter of transistor Q1 and a ground potential 32. A wiper tap 42 between resistor R2 and the inverting terminal of amplifier AV1 forms a current sensitive negative feedback loop. This feedback signal, shown as waveform G in FIG. 2G, provides a constant current effect by regulating amplification of the ONE logic level by amplifier AV1 and thus, the voltage on the base of transistor C1 during the drive current pulse mode of each cycle. The tap on resistor R2 is variable to permit adjustment of the drive current amplitude to conform with the particular characteristics of lamp 20. The wiper tap 42 of resistor R2 is set to provide the minimum drive current sufficient to cause a plasma completely filling the bore of lamp 20.

When the ONE logic level is applied by amplifier AV1 to the base of transistor Q1, Q1 begins to conduct. This current generates a voltage at the emitter of transistor Q1 because of the current flow through resistors R1, R3. Current in transistor Q1 rises above the amplitude of the simmer current in lamp 20 as shown by waveform C of FIG. 2C. A voltage drop then occurs across resistors R2, R3, as indicated by waveform F. The circuitry of amplifier AV1 is linear and therefore allows current through transistor Q1 to stabilize. When the current in resistors R2, R3 is sufficient to produce a voltage drop at wiper tap 42 equal in amplitude to the reference voltage from multivibrator MV1, the base voltage of transistor Q1 stabilizes, consequently stabilizing the emitter voltage and current of transistor Q1. The collector voltage of transistor Q1 will then rapidly decrease, in step function, until the required lamp drive current (indicated by waveform C) is generated by partial discharge of capacitor C1. The current through lamp 20 caused by partial discharge of capacitor C1 drives lamp 20 beyond its negative resistance characteristic, making the energy radiated by lamp 20 conditionally stable as a function of drive current. The amplitude of current through lamp 20 is essentially equal to the emitter current of transistor Q1. The voltage potential of capacitor C1 drops as a linear ramp function over the duration of the drive pulse. The collector voltage of transistor Q1 will then continue to decrease by an equal amount in a linear ramp function as the voltage across capacitor C1 decreases. Consequently, the applied lamp voltage, and, therefore, the lamp current, remains constant during a drive pulse. The voltage on capacitor C1 decreases moderately during each drive current pulse; in normal operation, capacitor C1 is never fully discharged. Additionally, the voltage on the collector of transistor Q1 does not reduce sufficiently to saturate, thus avoiding excessive emission of radiant energy by lamp 20. Current through lamp 20 and R1 maintains the simmer condition, thus assuring a sharp response to the base drive signal initiating the total ionization part of each cycle. The linearity of the response of transistor Q1 effectively provides constant amplitude to the drive current pulse during the total ionization part of each cycle; this permits a highly stable flashlamp pumping condition which, in turn, assures stable and temporally invariant profiles for each laser pulse.

Upon expiration of the flash-time interval set by the pulse C of multivibrator MV1 at time $t_2$, the Q terminal reverts to a ZERO logic state. This transition marks the end of one complete cycle (and the beginning of the next) and removes the reference voltage (waveform E) on the non-inverting terminal of amplifier AV1 from a ONE to a ZERO logic level. This, in turn, removes the base drive voltage (waveform F) from transistor Q1, causing the transistor to become less conductive. The current flow in lamp 20, diode CR1, the collector-emitter path of transistor Q1, and resistors R2, R3 collectively represented by waveform H, abruptly falls to the respective simmer condition levels in those components. Then, the collector voltage of transistor Q1 rises toward the potential charge on capacitor C1 and current in resistor R1 rises. Simultaneously, current decreases to zero in diode CR1 and the potential across R2 and R3 falls to zero volts so that the lamp driver circuit is returned to its quiescent state. Ionization within lamp 20 continues, albeit at the reduced simmer condition level maintained within lamp 20 until application of another flash command. Application of flash command to terminal 30 at time $t_3$ by an external timing circuit during the next cycle causes the circuit to again drive lamp 20 into a total ionization pumping mode.

The particular circuit disclosed may be constructed with a xenon gas filled flashlamp 20, available from the International Lamp Company with either 450 to 750 torr pressure, pumping a Nd:YAG laser rod. A krypton gas filled flashlamp, with either 450 or 750 torr pressure also may be used. An arc partially filling the bore of lamp 20 is created by application of the negative ignition electrode 40 of lamp 20. The arc is able to support a simmer current typically between 100 and 125 milliamperes direct current from power supply 24. Any drive current between electrodes 22, 28 with an amplitude greater than about fifty amperes and ten to sixteen microseconds in duration is capable of completely filling the bore of lamp 20.

Capacitor C1, rated at 600 microfarads for 1000 volts, may be assembled from a bank of six discrete capacitors coupled in parallel. Power supply 24, rated to supply direct current at approximately 500 volts, 300 watts, charges capacitor C1 to about 500 volts. During the drive pulse, while driving lamp 20 in the pumping mode with a constant amplitude discharge current between 50 and 150 amperes, C1 discharges to about 450 volts; when lamp 20 is returned to a simmer condition, power supply 24 recharges C1 to 500 volts.

A flash-time interval longer than 100 microseconds is usually necessary to give adequate damping time to relaxation oscillations in the laser medium being pumped. The disclosed circuit provides a flash-time interval of between 25 microseconds and 1 millisecond (between 100 and 600 microseconds is preferred); this pulse length constitutes about one-tenth of one percent of a duty cycle. In practice, this circuit should have an efficiency of between 50 and 75%, providing the flashlamp with a pumping efficiency of between about 1.8 and 2.0%.

Figure 3B:
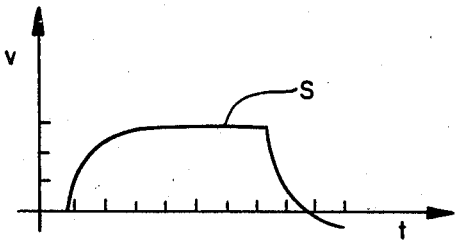
FIG. 3B is a two coordinate graphic representation of a flashlamp irradiance emission pulse waveform as a function of time.
Figure 3C:
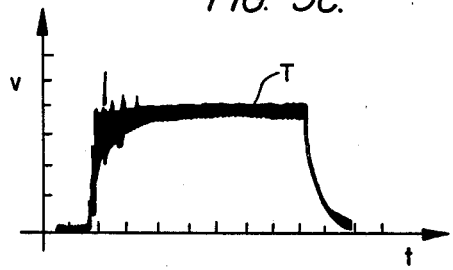
FIG. 3C is a two coordinate graphic representation of a waveform of a pulse of stimulated emission from a laser medium.

A typical, observed drive current pulse of approximately 350 microseconds is shown by waveform R in FIG. 3A. The instanteous pulse power transferred to the flashlamp during the pulse is on the order of 120,000 watts. The waveform of an observed, stable light pulse of about 337 microseconds emitted by lamp 20 in response to the current pulse shown in FIG. 3A, is represented by waveform S in FIG. 3B. The temporal profile of a laser pulse emitted by a laser medium pumped with the light pulse shown in FIG. 3B, is represented by waveform T of FIG. 3C as a single, quasi-continuous wave pulse with very little perturbation of energy. Relaxation oscillations are extinguished within the first one-third of laser pulse T.

A circuit for driving a laser flashlamp pump is disclosed with separate adjustments for setting the amplitude and width of rectangular current discharge pulses driving flashlamp to conform to the dynamics of the laser medium. The circuit cyclically provides these stable current pulses necessary to achieve pulsed, quasi-continuous emission by the laser medium. The transistor used as the current mode switch never being saturated, the circuit provides a linear response whereby the current pulse to the flashlamp is constant in amplitude with less than one-half of one percent ripple. The transistor is held in an active state above ground potential, thereby providing a sharp, substantially rectangular waveform to the current pulse. This circuit permits optical pumping adequate to obtain a long pre-lase time for an actively mode locked laser oscillator, thereby allowing the laser to generate stable mode locked pulses exhibiting the uniformity of profile essential to the demands for precision.

Figure 4:
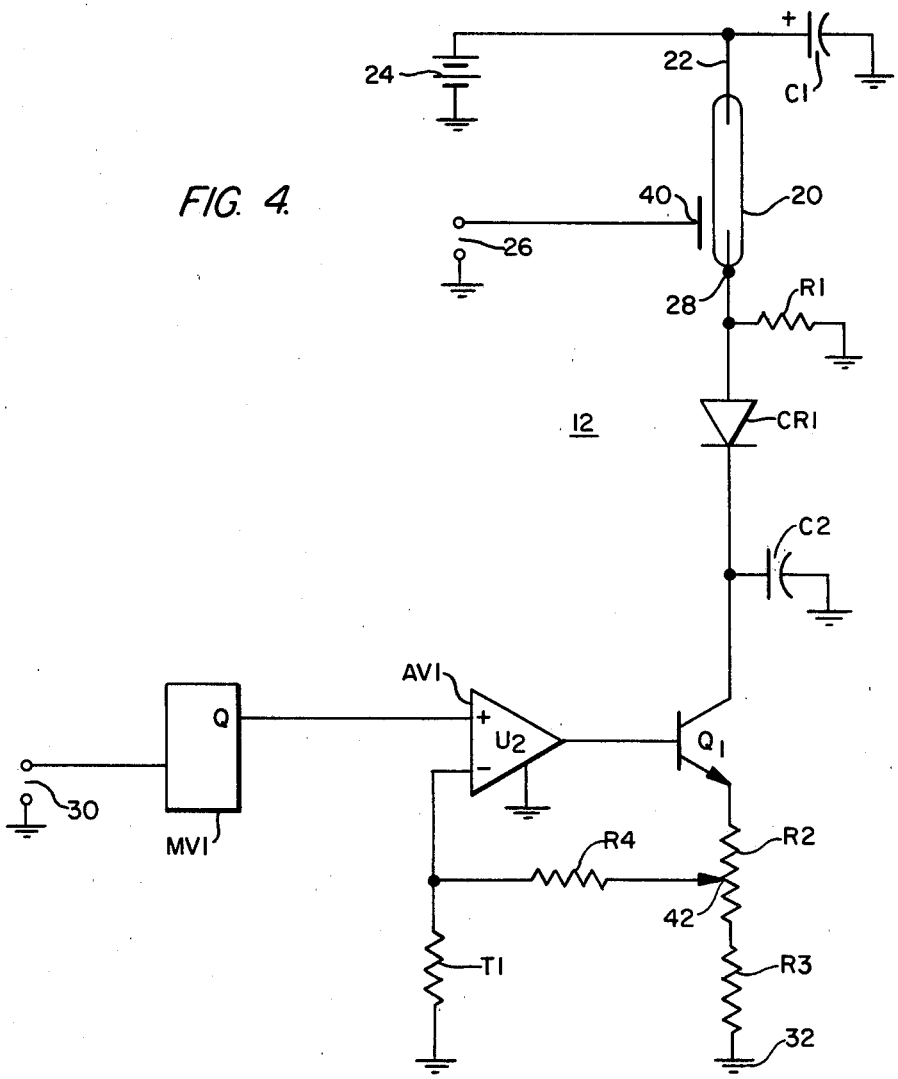
FIG. 4 is a simplified schematic diagram of an alternative driver circuit.

The sense current feedback loop formed by resistor R2 and the inverting terminal of operational amplifier AV1 is one mechanism for compensating for one variable affecting stability of the laser medium—the current flowing through lamp 20 during the total ionization mode. There are numerous other variables affecting stability of the laser medium. One of those variables is the ambient temperature of the laser medium within the resonator cavity of the laser transmitter. A decrease in that ambient temperature tends to increase the efficiency of the resonator cavity; consequently, a reduction of ambient temperature means that a lower flashlamp drive current is required to pump the laser medium. As shown in FIG. 4, a conventional temperature sensitive device such as a thermistor T1 may be incorporated into lamp driver circuit 12, thereby providing an analogue signal to the inverting terminal of amplifier AV1 with a magnitude inversely proportional to the ambient temperature of the resonator cavity. The arrangement provides a mechanism to compensate for another variable affecting the stability of the laser medium. In this arrangement, a bridge resistance R4 separates thermistor T1 from wiper tap 42.

It is to be understood that the terms "light," "light pulse," and "laser energy" are used in this application not as limited to the visible spectrum of electromagnetic radiation, but as in the broad sense of radiant energy.

Furthermore, the term "stable pulse" means a pulse of energy exhibiting a temporal shape which does not vary in amplitude or width between different cycles. The phrase "percent ripple" refers to the ratio of the root-mean-square value of the ripple voltage to the absolute value of the total voltage, expressed in percent.

I claim:

1. A circuit for driving a gaseous flashlamp, comprising:

circuit switching means;

means generating an output for varying said circuit switching means between two operation modes;

means for applying a potential impulse to a first terminal connectable to one electrode of the flashlamp to initiate ionization thereof;

energy supply means for applying a first potential continuously and directly to a second terminal connectable to a second electrode of the flashlamp, said first potential having sufficient magnitude to maintain partial ionization in the flashlamp when said circuit switching means is in one of its operational modes;

energy storage means exhibiting a single and capacitive reactive impedance component chargeable by said energy supply means for applying a second potential directly to said second terminal of a magnitude sufficient to effect complete ionization of the flashlamp when said circuit switching means is in the other of its operational modes; and means for providing a signal to said varying means proportional to the amplitude of current flowing through said flashlamp during said other operational mode in response to reception of said signal, whereby said circuit switching means controls the amplitude of electrical current flowing through said second electrode caused by potential applied by said energy storage means to said second terminal during the period of said other mode.

2. The circuit of claim 1 wherein said circuit switching means and said signal providing means furnish a path for discharge of said energy storage means only while said circuit switching means is in the other of its operational modes.

3. The circuit of claim 2 wherein said magnitude of said second potential is a function of said energy storage means exhibiting a capacitive impedance component.

4. The circuit of claim 3 wherein said signal providing means comprises a first resistive impedance component coupled to receive discharge of said energy storage means through said flashlamp during said other operational mode.

5. The circuit of claim 4 further comprising a resistive impedance component coupled to receive current flowing through said flashlamp during said one operational mode.

6. The circuit of claim 5, further comprising means for electrically isolating said circuit switching means from said flashlamp during said one operational mode.

7. The circuit of claim 6 further comprising means susceptible to an ambient condition and connected to said varying means for modifying the amplitude of said signal in response to change in the ambient environment of the flashlamp.

8. A circuit for optically pumping a laser medium comprising:

a partially evacuated flashlamp tube exhibiting a negative resistance characteristic with a longitudinal bore containing an ionizable gas between an anode oppositely positioned at one end of said tube from a cathode electrode;

a storage capacitor coupled to discharge directly through said anode;

an ignition voltage source coupled to a third electrode of said flashlamp, for applying a voltage spike to said third electrode with sufficient magnitude to create an arc of partial ionization of gas within said bore;

a direct current power supply directly coupled to said anode and continuously providing energy to said anode for maintaining said arc of partial ionization of said gas while cyclically charging said storage capacitor to a potential of sufficient magnitude to fill said bore with a plasma of said gas;

a transistor with an emitter, connected in a common emitter configuration with the collector operatively coupled to said cathode electrode;

bias means coupled to the base of said transistor to hold a junction between said emitter and collector in a reverse bias condition;

a multivibrator cyclically generating a reference voltage pulse of predetermined duration;

an operational amplifier coupled between said transistor and said multivibrator and being receptive to the reference voltage pulse to provide a drive signal to said base of sufficient magnitude to forwardly bias said junction between said base and said collector during reception of said reference voltage pulse;

a reference potential source having a lower voltage than the potential of said power supply; and an impedance coupled between said emitter and said reference potential, having a tap coupled to said operational amplifier thereby providing said operational amplifier with a sense signal proportional in magnitude to the amplitude of electrical current through said emitter.

9. The circuit of claim 8, wherein said:

impedance includes an adjustable tap; and said operational amplifier is receptive to the reference voltage pulse and to a voltage at said adjustable tap, on different of a non-inverting terminal and an inverting terminal.

10. The circuit of claim 8, further comprising a diode interconnecting said cathode electrode and said collector.

11. The circuit of claim 8, further comprising:

a resistive impedance coupled between the cathode electrode and a ground potential for establishing the level of electrical current between said anode and cathode during partial ionization of said gas; and a capacitor coupled between the collector and a ground potential, for suppression of electrical current caused by application of said voltage spike to said third electrode.

12. The circuit of claim 8 further comprising means susceptible to an ambient condition for modifying the amplitude of said sense signal in inverse proportion to change in the ambient environment of the flashlamp.

13. A circuit for generating optical energy, comprising:

a partially evacuated tube with a bore containing an ionizable gas between an anode electrode disposed apart from a cathode electrode, exhibiting a negative resistance characteristic during a first operational condition occurring in response to application of a voltage to said anode electrode with sufficient magnitude for maintaining a minor electrical current through an arc of partial ionization of said gas, a change from said first condition to a second operational condition occurring upon an increase in said minor current to a major current with sufficient magnitude for causing a plasma of said gas to fill said bore, and a change from said second condition to said first condition occurring in response to a decrease in said major current to the level of said minor current;

energy storage means exhibiting a single and capacitive reactive impedance component for supplying said major electrical current to said electrodes during said second operational condition;

energy supply means for applying said voltage directly and continuously to said anode electrode and providing energy during said first operational condition directly to said energy storage means;

circuit switching means for providing a variable internal impedance for discharge of said energy storage means through said tube during said second operational condition;

amplification means for periodically shifting said tube between said first and second operational conditions by varying said internal impedance of said circuit switching means between a non-conducting mode and a linearly responsive conducting mode; and sensing means responsive to the amplitude of said electrical currents, providing a first signal to said amplification means whereby said internal impedance is varied by said operational means linearly in dependence upon amplitude of said electrical currents.

14. The circuit of claim 13 further comprising:

biasing means for holding said internal impedance of said circuit switching means at a higher impedance during said first operational condition; and resistive means for providing an intermediate level of impedance between said cathode and a ground potential during said first operational condition.

15. The circuit of claim 13 wherein said circuit switching means further comprises a transistor arranged in a common emitter configuration.

16. The circuit of claim 15 wherein said amplification means further comprises an active device providing a second signal to the base of said transistor dependent in magnitude upon a difference between the level of a logic state and said first signal.

17. The circuit of claim 13 further comprising means susceptible to an ambient condition for modifying the amplitude of said first signal in inverse proportion to change in the ambient environment of said partially evacuated tube.

* * * * *